US007002526B1

(12) United States Patent
Adams et al.

(10) Patent No.: US 7,002,526 B1
(45) Date of Patent: Feb. 21, 2006

(54) INTEGRATED MAN-PORTABLE WEARABLE ANTENNA SYSTEM

(75) Inventors: Richard C. Adams, Chula Vista, CA (US); Robert J. O'Neil, San Diego, CA (US); Jovan E. Lebaric, Carmel, CA (US); Todd R. Emo, Okinawa (JP)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/927,223

(22) Filed: Aug. 26, 2004

Related U.S. Application Data

(63) Continuation-in-part of application No. 10/677,189, filed on Oct. 2, 2003, now Pat. No. 6,972,725, which is a continuation-in-part of application No. 10/263,943, filed on Oct. 3, 2002, now Pat. No. 6,788,262, which is a continuation-in-part of application No. 10/061,639, filed on Jan. 31, 2002, now Pat. No. 6,590,540.

(51) Int. Cl.
*H01Q 1/12* (2006.01)

(52) U.S. Cl. ..... 343/718; 343/729

(58) Field of Classification Search ..... 343/718, 343/725, 729, 897, 893, 742, 876; H01Q 1/12
See application file for complete search history.

(56) References Cited

U.S. PATENT DOCUMENTS 6,356,238 B1 * 3/2002 Gainor et al. ..... 343/718
6,621,457 B1 * 9/2003 Adams et al. ..... 343/718
6,788,262 B1 * 9/2004 Adams et al. ..... 343/718

OTHER PUBLICATIONS

Adams, R. C., et al., "COMWIN Antenna Project: Final Report FY 1999 to 2002," Technical Report 1892, Sep. 2002, pp. 1-78, SSC San Diego.

* cited by examiner

*Primary Examiner*—Hoanganh Le
(74) *Attorney, Agent, or Firm*—Peter A. Lipovsky; Michael A. Kagan; Allan Y. Lee

(57) ABSTRACT

A man-portable wearable antenna system to be worn by a wearer. The wearable antenna system comprises a helmet antenna, a vest antenna worn around the torso, a body antenna worn along the entire body, and a means for routing signals between one of the antennas and a communication device.

15 Claims, 10 Drawing Sheets

INTEGRATED MAN-PORTABLE WEARABLE ANTENNA SYSTEM

CROSS REFERENCES TO RELATED APPLICATIONS

This application is a continuation-in-part of U.S. patent application Ser. No. 10/677,189, entitled IMPROVED ULTRA-BROADBAND ANTENNA INCORPORATED INTO A GARMENT, filed on Oct. 2, 2003, now U.S. Pat. No. 6,972,725 which is a continuation-in-part of U.S. patent application Ser. No. 10/263,943, entitled ULTRA-BROADBAND ANTENNA INCORPORATED INTO A GARMENT WITH RADIATION ABSORBER MATERIAL TO MITIGATE RADIATION HAZARD, filed on Oct. 3, 2002, now U.S. Pat. No. 6,788,262, which is a continuation-in-part of U.S. patent application Ser. No. 10/061,639, entitled ULTRA-BROADBAND ANTENNA INCORPORATED INTO A GARMENT, filed on Jan. 31, 2002 and issued as U.S. Pat. No. 6,590,540 on Jul. 8, 2003, and which is herein incorporated by reference.

BACKGROUND OF THE INVENTION

This invention relates generally to the field of antennas. More specifically, this invention relates to an integrated man-portable wearable antenna, comprising multiple antennas.

The Joint Tactical Radio System, a Department of Defense initiative to provide network connectivity across much of the radio frequency spectrum, requires ultra-broadband antenna capability—the ability to send or receive a signal at any frequency between 2 MHz and 2000 MHz. Because disruption of command, communications, and control is a paramount goal of snipers, reduction of the visual signature of an antenna is highly desirable. Therefore, a need exists for a broadband, man-carried antenna that does not have a readily identifiable visual signature.

BRIEF DESCRIPTION OF THE DRAWINGS

For a more complete understanding of the integrated man-portable wearable antenna system, reference is now made to the following detailed description of the embodiments as illustrated in the accompanying drawings wherein.

DESCRIPTION OF THE EMBODIMENTS

Figure 5A:
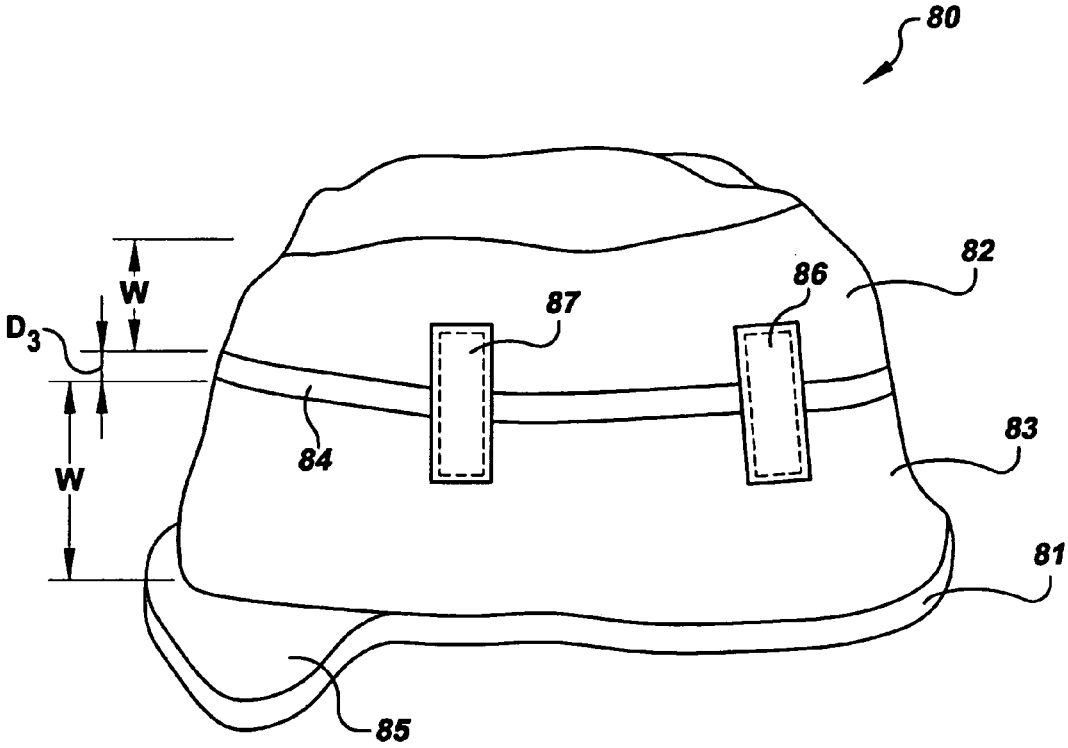
FIG. 5A shows a perspective view of a helmet antenna.
Figure 5B:
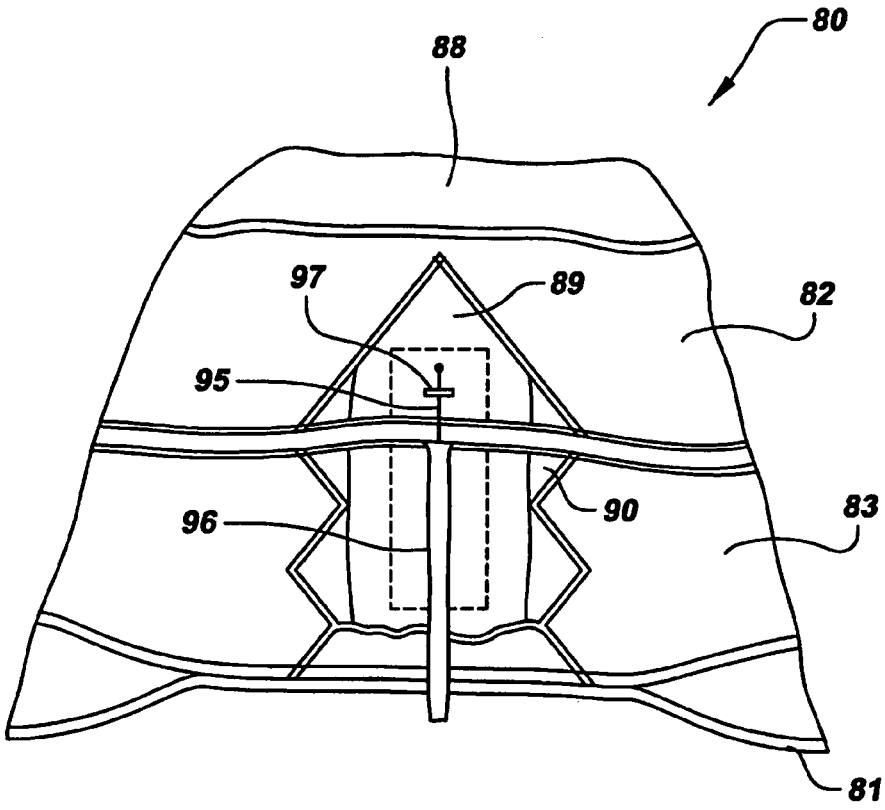
FIG. 5B shows another view of the helmet antenna of FIG. 5A.
Figure 6:
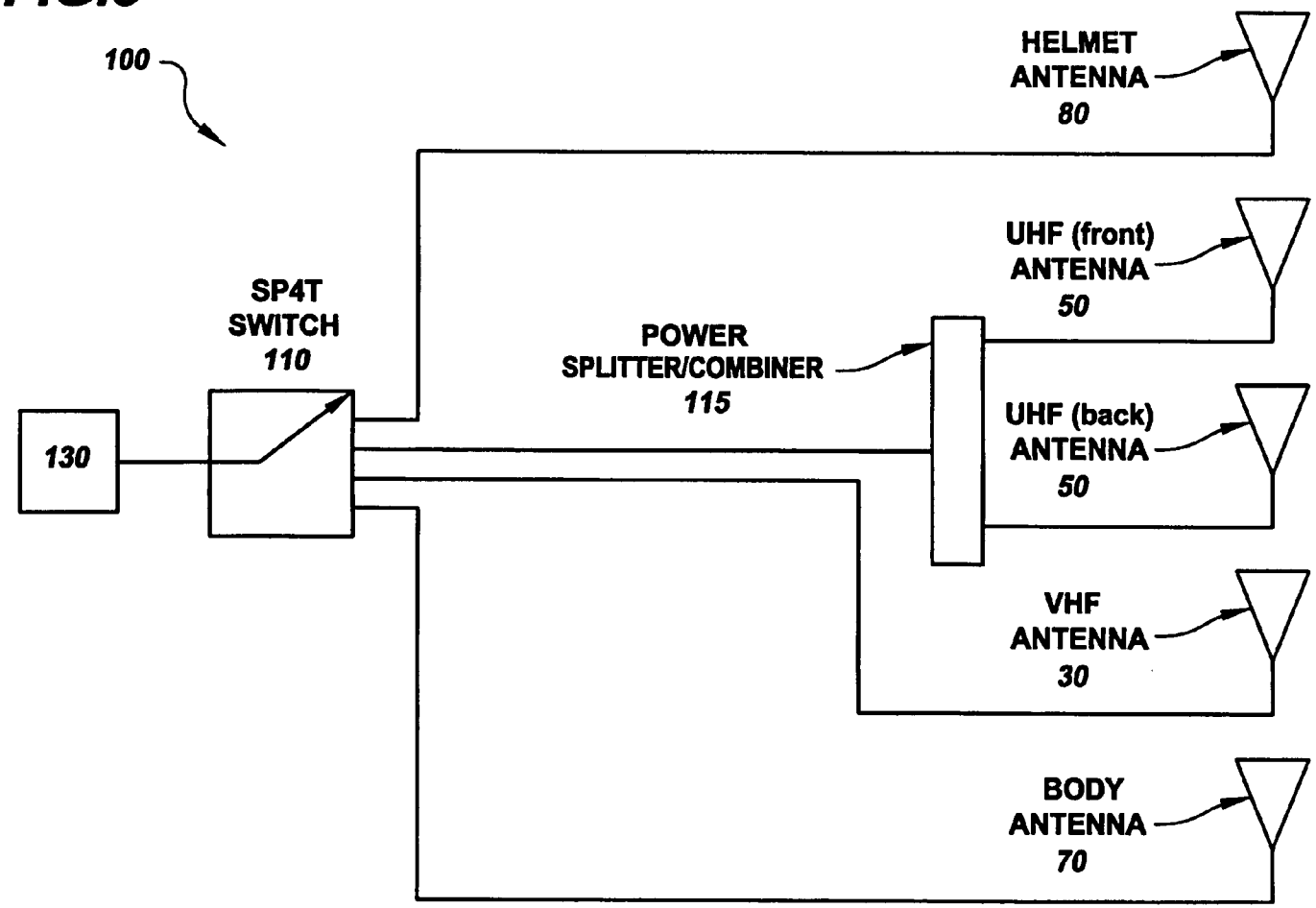
FIG. 6 is a block diagram of a distribution system that routes the signals between the antennas and a communication device.
Figure 7:
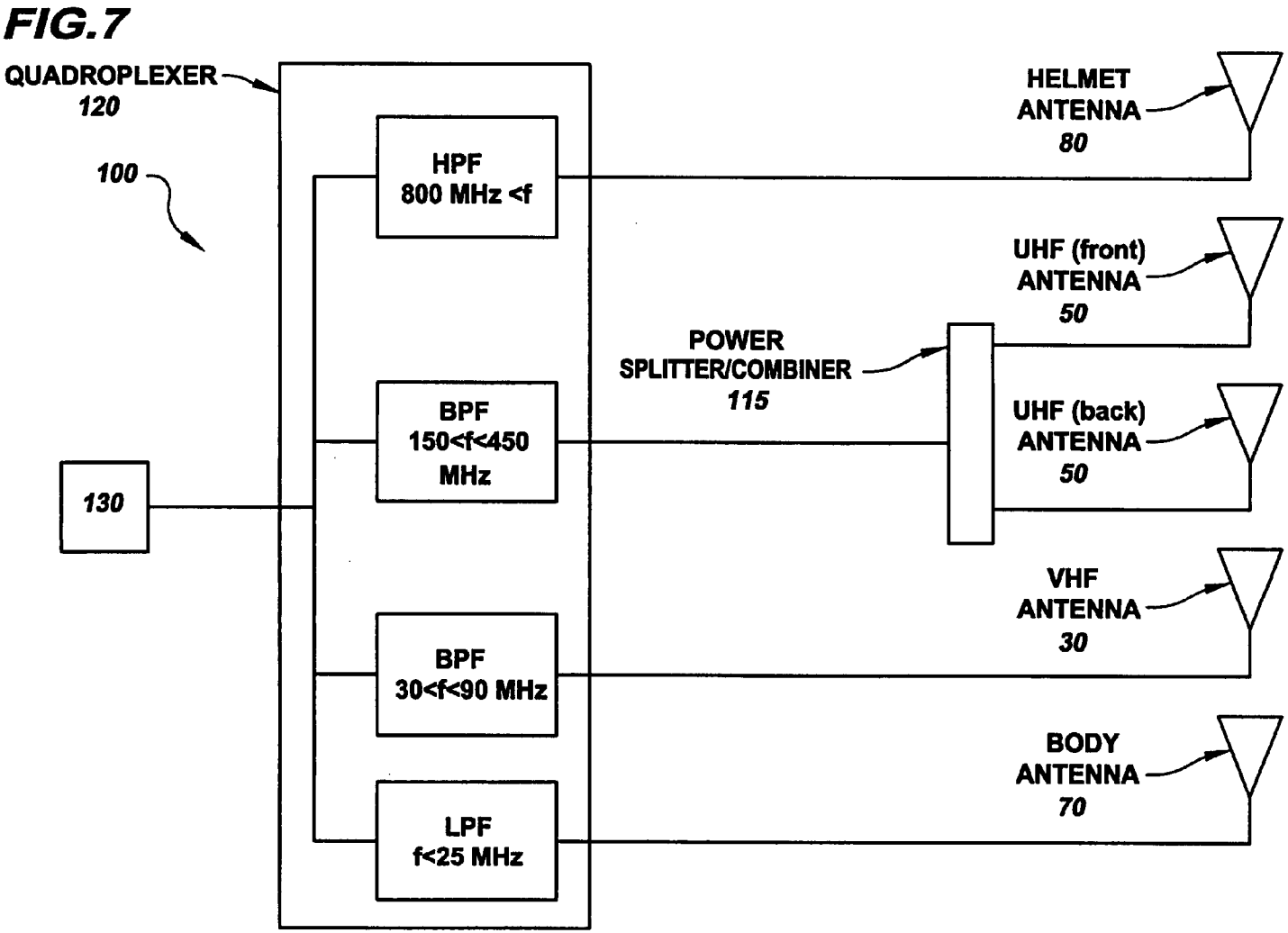
FIG. 7 is a block diagram of another embodiment of the distribution system of FIG. 6.

A man-portable wearable antenna system 10 worn by a human wearer comprises vest antenna 20 (shown in FIGS. 1A and 1B), body antenna 70 (shown in FIGS. 2A and 2B), helmet antenna 80 (shown in FIGS. 1A, 5A, and 5B), and distribution system 100 (shown in FIGS. 6 and 7).

Figure 1A:
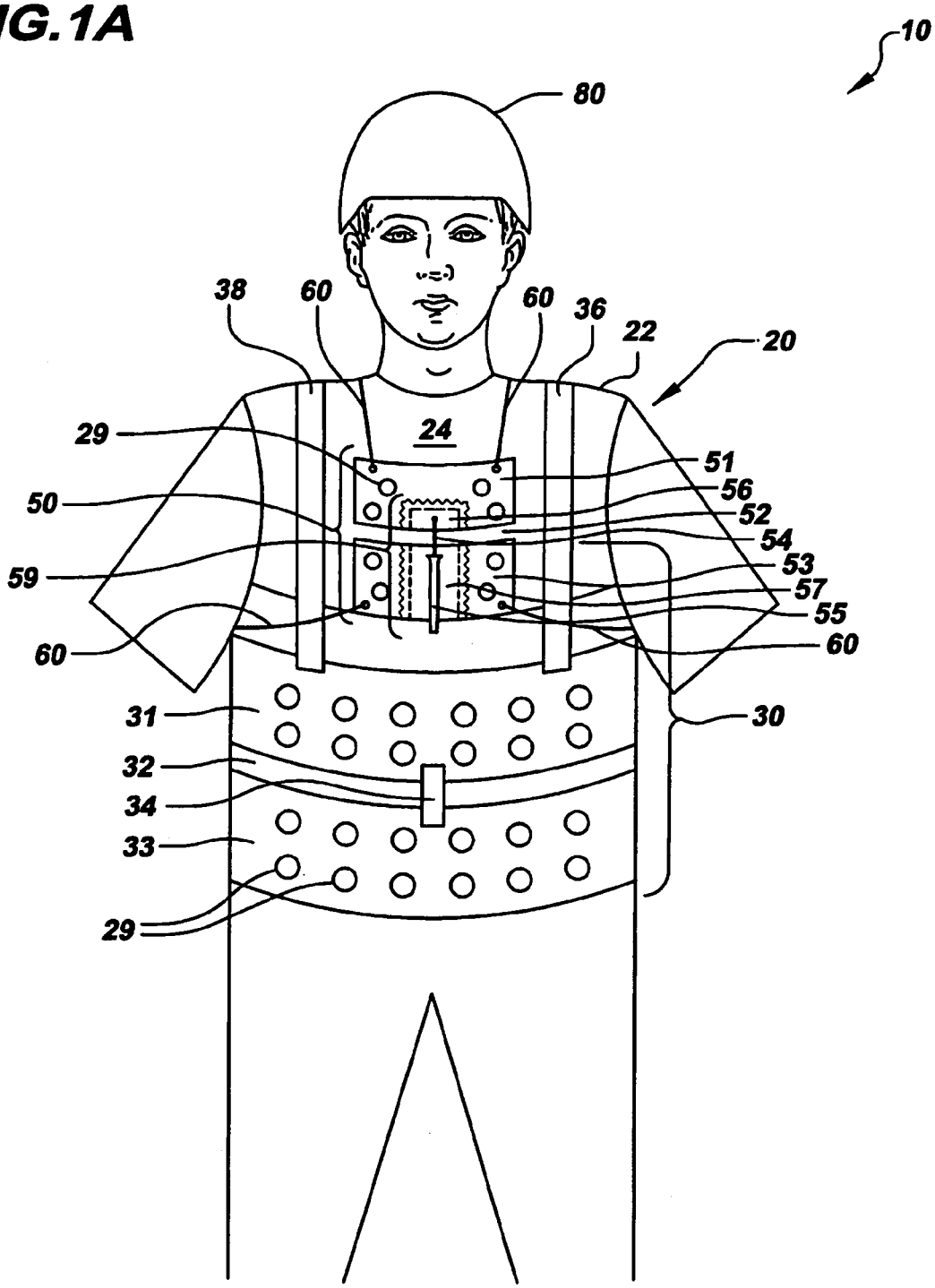
FIG. 1A illustrates an anterior view of a vest antenna incorporated into a garment as shown worn by a wearer.
Figure 1B:
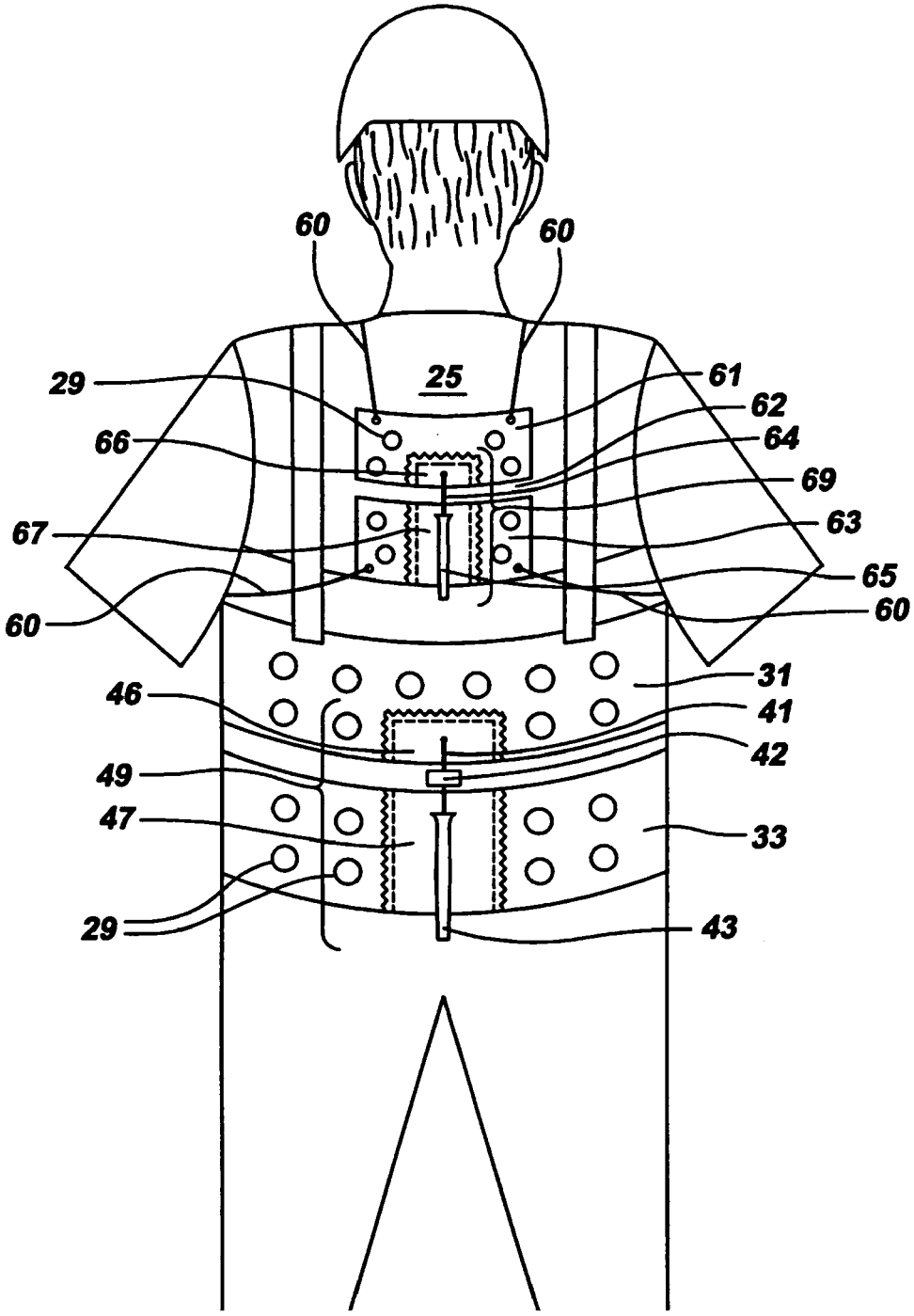
FIG. 1B shows a dorsal view of the vest antenna shown in FIG. 1.

Referring now to FIGS. 1A and 1B, vest antenna 20 worn by a human wearer is shown. Vest antenna 20 comprises VHF antenna 30, which operates over a frequency range of about 30 MHz to about 100 MHz, and UHF antenna 50, which operates over a frequency range of about 100 MHz to about 500 MHz. Vest antenna 20 is integrated into garment 22 so that vest antenna 20 offers no distinctive visual signature that would identify the person wearing the antenna as a radio operator. Garment 22 is made of an electrically nonconductive material such as a woven fabric selected from the group that includes cotton, wool, polyester, nylon, Kevlar®, rayon, and the like. The electrically conductive material of garment 22 may also include polyurethane for waterproofing. Garment 22 has anterior or front section 24 and dorsal or back region 25.

VHF antenna 30 comprises first and second VHF radio frequency (RF) elements 31 and 33, shorting strap 34, left shoulder strap 36, and right shoulder strap 38, all of which are attached to garment 22. VHF RF elements 31 and 33 are attached to garment 22 so that the RF elements are separated by VHF gap 32, having a distance $D_1$. Generally, $D_1 \leqq 2.5$ cm, although the scope of the invention includes the distance $D_1$ being greater than 2.5 cm as may be required to suit the requirements of a particular application. When RF energy is input, a voltage difference is generated across VHF gap 32.

VHF feed region 49 of VHF antenna 30 is shown in FIG. 1B. A flexible, electrically conductive patch 46 is sewn and/or bonded to the bottom center area portion of first VHF RF element 31 on the dorsal side 25 of garment 22. A flexible, electrically conductive patch 47 is also sewn and/or bonded to the center area of second VHF RF element 33 on the dorsal side 25 of garment 22. Patches 46 and 47 are separated by VHF gap 32. VHF RF feed 41 and VHF ground feed 43 are electrically connected to patches 46 and 47, respectively, by soldering or other conventionally known methods for electrically connecting a wire to another electrically conductive structure. VHF impedance matching circuit 42 is used to finely match the impedance of VHF antenna 30 with an external load (not shown) and the impedance of the wearer. Patches 46 and 47 provide a generally heat resistive buffer so that VHF RF feed 41 and VHF ground feed 43 may be soldered to VHF antenna 30 without causing heat damage that would otherwise result if VHF RF feed 41 and VHF ground feed 43 were directly soldered to VHF RF elements 31 and 33. It is to be understood that VHF RF feed 41 and VHF ground feed 43 are RF isolated from each other. By way of example, patches 46 and 47 may be made of electrically conductive copper foil tape such as 3M Scotch Tape, Model No. 1181.

Still referring to FIGS. 1A and 1B, UHF antenna 50 comprises identical elements on the front section 24 and the back region 25 of garment 22. First and second front UHF RF elements 51 and 53 are located on the front section 24, and first and second back UHF RF element 61 and 63 are located on the back region 25. By way of example only, UHF RF elements 51, 53, 61, and 63 are rectangular elements. However, elements that may also be used include a triangle (to form a bowtie antenna), a teardrop with a tapered feed, a "home plate," and others. UHF antenna 50 also includes insulated connecting wires 60, which improve the efficiency of UHF antenna 50. Insulated connecting wires 60 electrically connect front UHF RF element 51 to back UHF RF element 61 and electrically connect front UHF RF element 53 to back UHF RF element 63.

Front UHF feed region 59 of UHF antenna 50 is shown in FIG. 1A. A flexible, electrically conductive patch 56 is sewn and/or bonded to the bottom center area portion of first front UHF RF element 51. A flexible, electrically conductive patch 57 is also sewn and/or bonded to the center area of second front UHF RF element 53. Patches 56 and 57 are separated by front UHF gap 52, having a distance $D_2$. Generally, $D_2 \leqq 0.7$ cm, although the scope of the invention includes the distance $D_2$ being greater than 0.7 cm as may be required to suit the requirements of a particular application. Front UHF RF feed 54 and front UHF RF ground feed 55 are electrically connected to patches 56 and 57, respectively, by soldering or other means.

Back UHF feed region 69 of UHF antenna 50 is shown in FIG. 1B. A flexible, electrically conductive patch 66 is sewn and/or bonded to the bottom center area portion of first back UHF RF element 61. A flexible, electrically conductive patch 67 is also sewn and/or bonded to the center area of second back UHF RF element 63. Patches 66 and 67 are separated by back UHF gap 62, having a distance $D_2$. Back UHF RF feed 64 and back UHF RF ground feed 65 are electrically connected to patches 66 and 67, respectively, by soldering or other means.

As shown in FIGS. 1A and 1B, VHF RF elements 31 and 33 and UHF RF elements 51, 53, 61, and 63 of vest antenna 20 includes openings 29 to provide ventilation to the wearer. If included, the openings should be less than about $0.1\lambda$, where $\lambda$ represents the shortest wavelength of the radio frequency signal that is to be detected or transmitted. With the minimum wavelength of 3 for vest antenna 20, openings of less than 0.3 should permit air to flow to the wearer without affecting the electromagnetic properties such as impedance, gain, and radiation hazard.

Figure 2A:
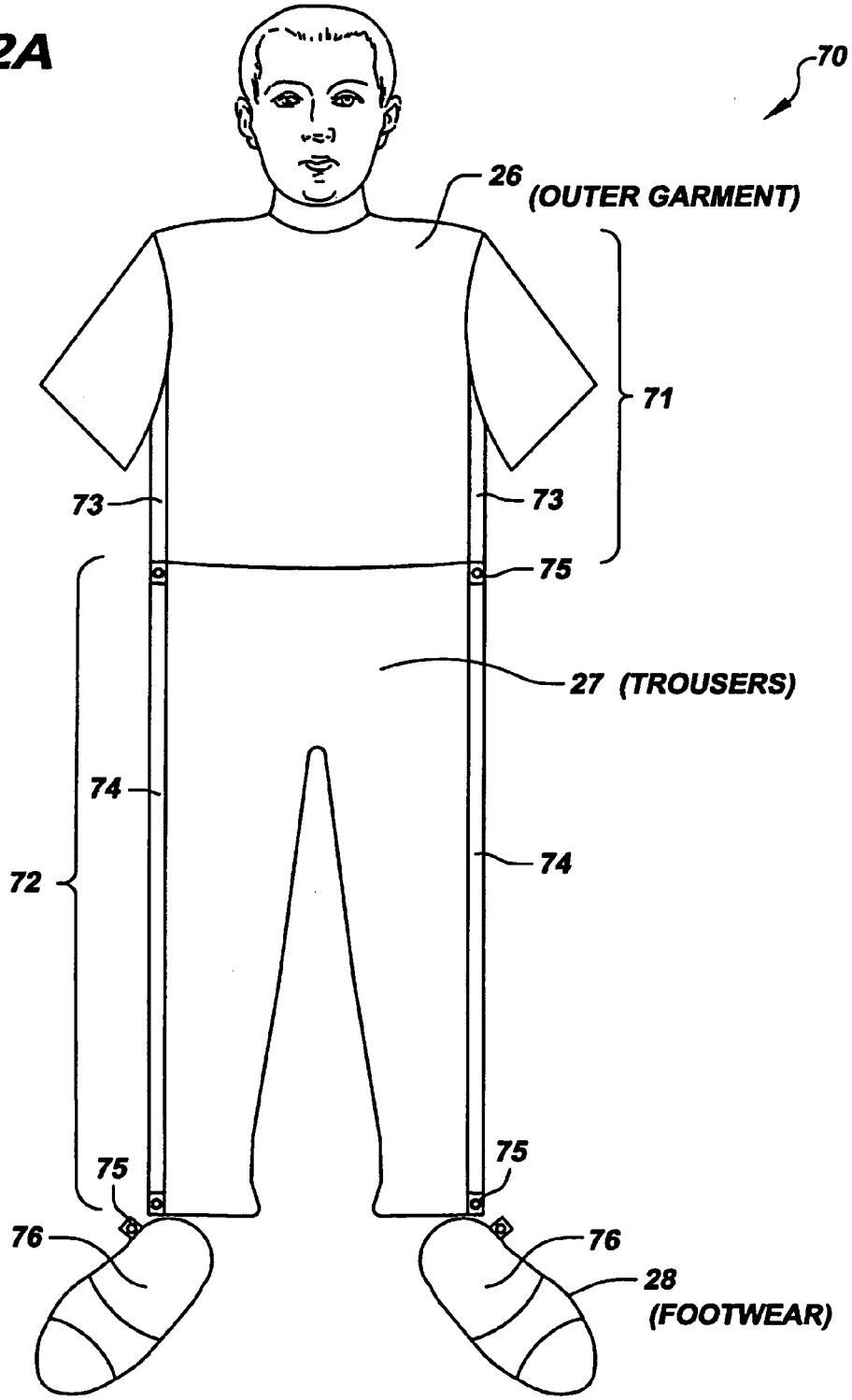
FIG. 2A illustrates an anterior view of a body antenna incorporated into a garment.
Figure 2B:
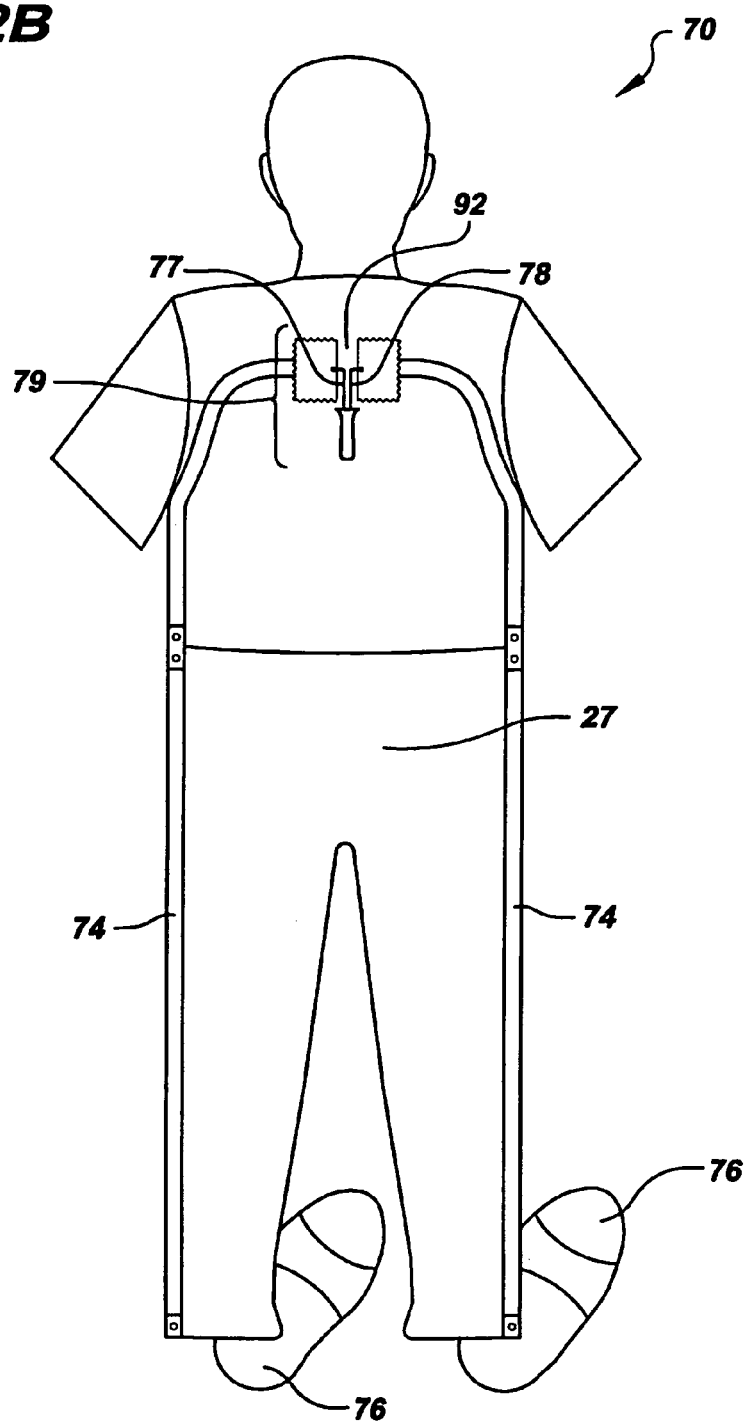
FIG. 2B shows a dorsal view of the body antenna shown in FIG. 2A.

Referring now to FIGS. 2A and 2B, body antenna 70 of man-portable wearable antenna system 10 is shown. Body antenna 70 operates over a frequency range of about 2 MHZ to about 30 MHz. Body antenna 70 comprises upper portion 71 and lower portion 72. Upper portion 71 of body antenna 70 comprises conductive elements 73 along the sides of outer garment 26, which connect to feed region 79 located on the dorsal region of garment 26. Feed region 79 comprises HF feed 77 and HF ground feed 78. Lower portion 72 of body antenna 70 comprises conductive strips 74, which are attached along the sides of trousers 27 in such an orientation as to extend substantially along the length of trousers 27 and vertically when the wearer is in a standing position. Body antenna 70 further comprises conductive sole inserts 76 lining the inner soles of footwear 28. Connectors 75 such as snaps, for example, connect conductive elements 73 to corresponding conductive strips 74 and conductive sole inserts 76.

Figure 3:
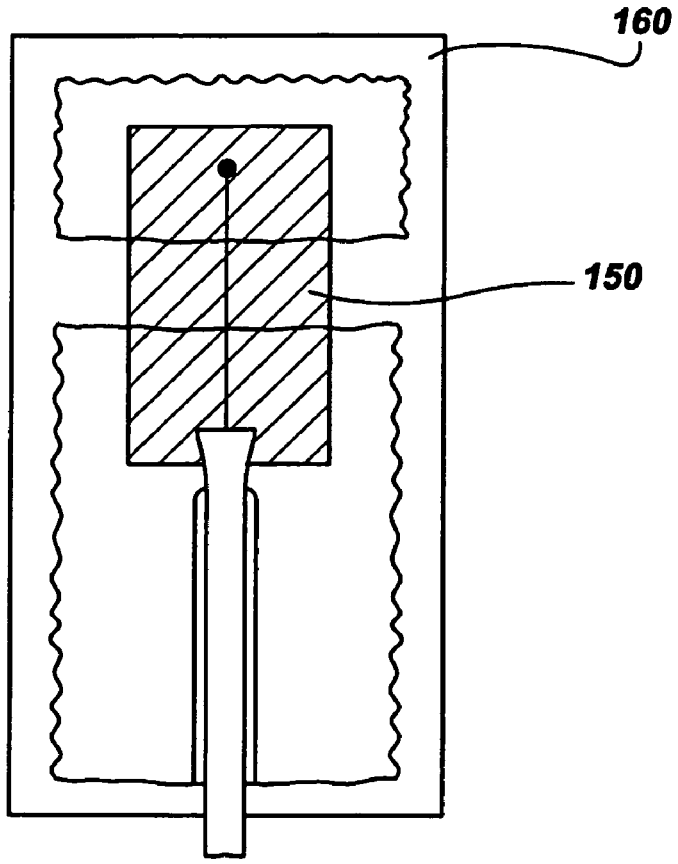
FIG. 3 illustrates a feed region.

VHF feed region 49, UHF feed regions 59 and 69, and HF feed regions 79, shown in FIGS. 1A, 1B, and 2B, are structurally weak points in wearable antenna system 10, especially near the gaps 32, 52, 62, and 92 of each region. To strengthen these regions, epoxy coating 150 is applied to one side of the feed region and rigid insulator 160 is placed on the other side, as shown in FIG. 3. By way of example only, Teflon® may be used as rigid insulator 160.

Figure 4:
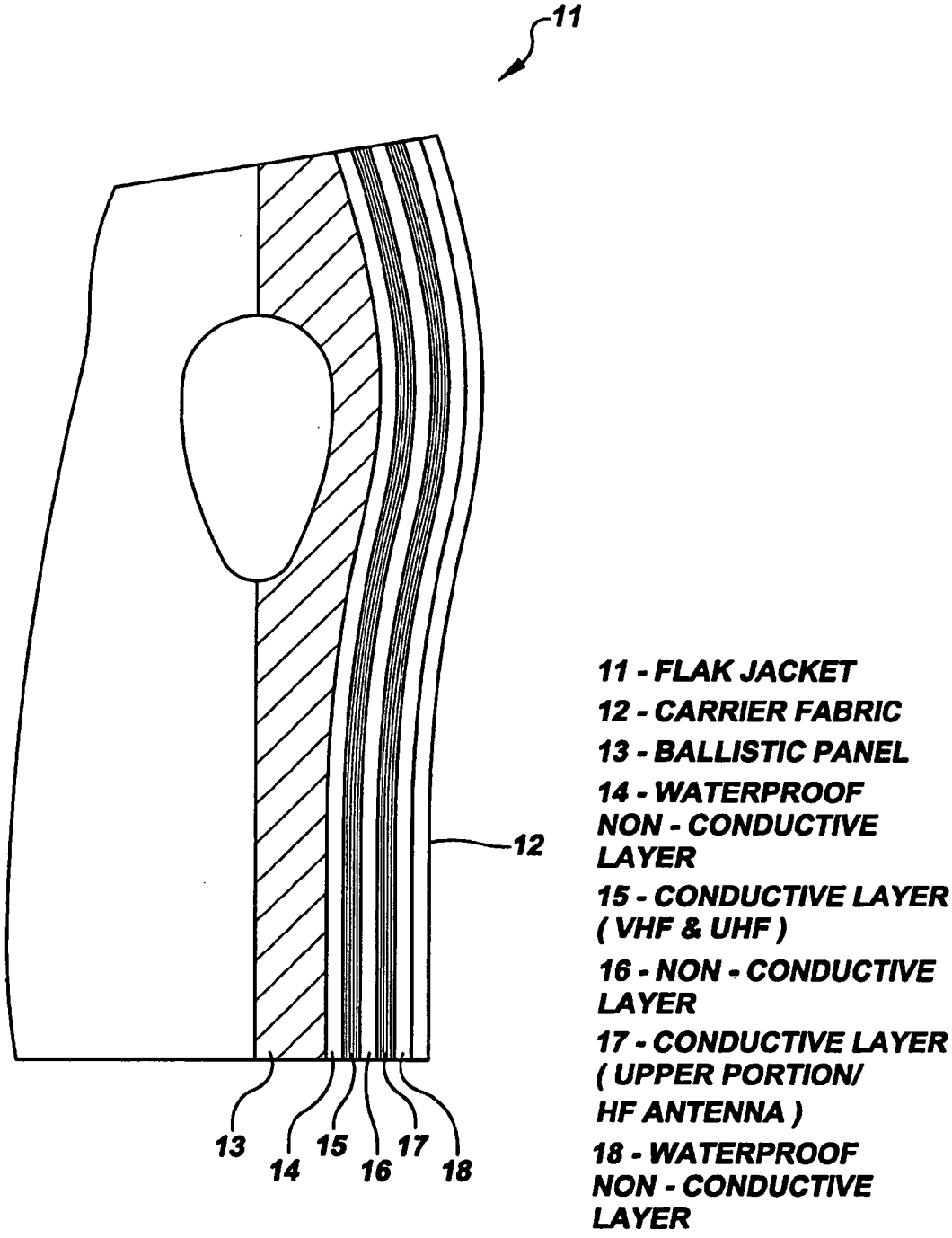
FIG. 4 shows a section view of an antenna integrated into a flak vest.

In one embodiment of man-portable wearable antenna system 10, VHF antenna 30 and UHF antenna 50 of vest antenna 20 and upper portion 71 of body antenna 70 are integrated into military flak vest 11. As shown in FIG. 4, flak vest 11 comprises ballistic panel 13, which is commonly assembled from multiple layers of ballistic fabric or other ballistic resistant materials such as Kevlar®, inserted into carrier material 12, which is constructed of conventional fabrics such as nylon or cotton. Conductive layer 15 forming VHF antenna 30 and UHF antenna 50 of vest antenna 20 is formed between two non-conductive layers 14 and 16. Conductive layer 17 forming upper portion 71 of body antenna 70 is formed between non-conductive layers 16 and 18. Non-conductive layer 16 electrically isolates upper portion 71 of body antenna 70 from VHF antenna 30 and UHF antenna 50 of vest antenna 20. Non-conductive layers 14, 16, and 18 are preferably constructed of waterproof material so that the operation of the antennas is not degraded by moisture. Example materials that may be used for non-conductive layers 14, 16, and 18 include polyurethane coated fabric and Gore-Tex®.

Now referring to FIGS. 5A and 5B, helmet antenna 80, described in U.S. Pat. No. 6,621,457, which is herein incorporated by reference, provides an antenna that includes a liner shaped to fit over a helmet. As shown in FIG. 5A, helmet antenna 80 includes first and second helmet RF elements 82 and 83 respectively, each preferable made of electrically conductive and flexible material. When helmet antenna 80 is fitted around helmet 81, helmet RF elements 82 and 83 are each shaped as a tapered band or annulus. The annulus-shaped helmet RF elements and 83 are open on two sides, which provides helmet antenna 80 with ultra-wide-band performance. The widths of helmet RF elements 82 and 83 may be in the range of about 1 to 8 cm, depending on the desired frequency of helmet antenna 80.

RF elements 82 and 83 are mounted to an electrically insulating liner 85, which serves as a supporting substrate for RF elements 82 and 83. Liner 85 may, for example, be made of cotton, polyester, or other dielectric material that may be woven or non-woven and shaped to fit over helmet 81. RF elements 82 and 83 may be attached to liner 85, as for example, by being sewn or glued. RF elements 82 and 83 may also be attached directly to helmets made of dielectric material without any intervening liner. Helmet 81 may be implemented as any type of helmet, including combat and construction helmets.

RF elements 82 and 83 are separated by a gap 84 having a distance $D_3$ when helmet antenna 80 is fitted over helmet 81. Gap 84 provides a voltage difference between RF elements 82 and 83 when helmet antenna 80 is excited by RF energy. In typical applications, $D_3 \leqq 1.0$ cm, although the scope of the invention includes gap 84 having a distance greater than 1.0 cm as may be required to suit the requirements of a particular application.

Still referring to FIG. 5A, helmet antenna 80 includes first and second helmet shorting straps 86 and 87 that electrically connect first and second helmet RF elements 82 and 83. Shorting straps 86 and 87 are used to match the impedance of helmet antenna 80 with a device (not shown), such as a transmitter, transceiver, or receiver. The exact position of shorting strap 86 with respect to shorting strap 87 is generally empirically determined to suit the requirements of a particular application, whereby changing the position of the shorting straps causes the impedance of helmet antenna 80 to vary accordingly.

Now referring to FIG. 5B, electrically conductive patches 89, 90, and 91 are attached to the corresponding RF elements 82 and 83 at end 88 of helmet antenna 80 in order to provide good RF coupling between patches 89 and 90 and corresponding RF elements 82 and 83. As shown in FIG. 5B, electrically conductive patch 89 is shaped as a triangle while electrically conductive patch 90 is formed in a generally "sawtooth" configuration. Patches 89 and 90 are sewn or bonded to the RF elements to provide excellent electrical continuity and facilitate soldering RF feed 95 to RF element 82 and ground feed 96 to RF element 83 without damaging the RF elements.

The impedance of the head of the person wearing helmet 81 affects the impedance of helmet antenna 80. In order to facilitate finely matching the impedance of helmet antenna 80 with an external electronic device (not shown), an impedance matching circuit 97 may be connected between RF feed 95 and patch 89 that is electrically connected to RF element 82.

Referring to FIGS. 1A, 1B, 2A, 2B, 5A, and 5B, collectively, VHF RF elements 31 and 33, VHF shorting strap 34, shoulder straps 36 and 38, conductive patches 46 and 47, UHF RF elements 51, 53, 61, and 63, conductive patches 56, 57, 66, and 67, conductive elements 73, conductive strips 74, sole inserts 76, helmet RF elements 82 and 83, helmet shorting straps 86 and 87, and conductive patches 89, 90, and 91, are made of electrically conductive materials such as metal selected from the group that includes copper, nickel, and aluminum. In a preferred embodiment, VHF RF elements 31 and 33, VHF shorting strap 34, shoulder straps 36 and 38, conductive patches 46 and 47, UHF RF elements 51, 53, 61, and 63, conductive patches 56, 57, 66, and 67, conductive elements 73, conductive strips 74, sole inserts 76, helmet RF elements 82 and 83, helmet shorting straps 86 and 87, and conductive patches 89, 90, and 91, are made of an electrically conductive and very flexible mesh structure that includes woven copper or copper-coated fabric. If formed as a mesh, the mesh spacing should be less than about $0.1\lambda$, where $\lambda$ represents the shortest wavelength of the radio frequency signal that is to be detected or transmitted. One type of suitable, electrically conductive mesh is FlecTron®, which is available from Advanced Performance Materials, Inc. of St. Louis, now a division of Laird Technologies. The mesh size of FlecTron® is much less than $0.1\lambda$ for a frequency less than 3000 MHz. A further characteristic of FlecTron® is that it is breathable. Breathability is a very desirable characteristic to facilitate dissipation of heat and moisture generated by the wearer. However, the invention may be practiced wherein any or all of VHF RF elements 31 and 33, VHF shorting strap 34, shoulder straps 36 and 38, conductive patches 46 and 47, UHF RF elements 51, 53, 61, and 63, conductive patches 56, 57, 66, and 67, conductive elements 73, conductive strips 74, sole inserts 76, helmet RF elements 82 and 83, helmet shorting straps 86 and 87, and conductive patches 89, 90, and 91, may be made with electrically conductive structures that are not breathable.

FIG. 6 is a block diagram of distribution system 100 that combines helmet antenna 80, which is in the upper UHF band, VHF antenna 30 and UHF antenna 50 of vest antenna 20, and body antenna 70, which is in the HF band, to form an ultra-broadband antenna in the range of about 2 MHz to about 2500 MHz. As shown in FIG. 6, distribution system 100 comprises a single-pole, four-throw (SP4T) switch 110 that routes the signal between the appropriate antenna and radio 130. Power splitter/combiner 115 is used to ensure that UHF antenna 50 is able to transmit or receive a signal equally between the front and back. In this embodiment, operator intervention is required. In another embodiment of distribution system 100 shown in FIG. 7, a quadraplexer 120, which routes the signal based upon its frequency, may be used instead of a switch to direct the signal between the selected antenna and radio 130. The use of quadraplexer 120 eliminates the need for operator intervention but creates gaps in frequency coverage or "dead zones."

Clearly, many modifications and variations of the integrated man-portable wearable antenna system are possible in light of the above teachings. It is therefore to be understood that within the scope of the appended claims, the integrated man-portable wearable antenna and method for fabricating the same may be practiced otherwise than as specifically described.

We claim:

1. A man-portable wearable antenna system to be worn by a wearer, comprising:

a helmet antenna worn on the head of said wearer, wherein said helmet antenna transmits and receives signals over a frequency range of 500 MHz through 2500 MHz;

a vest antenna worn around the torso of said wearer, wherein said vest antenna transmits and receives signals over a frequency range of 30 through 500 MHz;

a body antenna worn along the entire body of said wearer, wherein said body antenna transmits and receives signals over a frequency range of 2 MHz through 30 MHz; and a means for routing signals between one of said antennas and a communication device.

2. The man-portable wearable antenna system of claim 1, wherein said helmet antenna comprises:

a liner shaped to fit over a helmet;

a first helmet RF element attached to said liner;

a second helmet RF element attached to said liner so that said first and second helmet RF elements are separated by a gap;

a helmet RF feed electrically connected to said first helmet RF element for providing energy to said first helmet RF element;

a helmet ground feed electrically connected to said second helmet RF element;

a first helmet shorting strap electrically connected to said first and second helmet RF elements opposite from said helmet RF feed; and a second helmet shorting strap electrically connected to said first and second helmet RF elements between said first helmet shorting strap and said helmet RF feed.

3. The man-portable wearable antenna system of claim 2, wherein said first and second helmet RF elements are made of a flexible electrically conductive material.

4. The man-portable wearable antenna system of claim 1, wherein said vest antenna comprises:

an electrically nonconductive garment having anterior and dorsal regions, left and right shoulder regions, left and right side regions;

a VHF antenna, comprising:

a first VHF RF element attached to said garment;

a second VHF RF element attached to said garment so that first and second VHF RF elements are separated by a gap;

a VHF RF feed electrically connected to said first VHF RF element on said dorsal region of said garment for providing energy to said first VHF RF element;

a VHF ground feed electrically connected to said second VHF RF element;

a VHF shorting strap for providing an electrical connection between said first and second VHF RF elements on said anterior region of said garment;

first and second shoulder straps electrically connected between said anterior and said dorsal regions of said first VHF RF element and which extend over said left and right shoulder regions of said garment; and a matching circuit electrically connected between said first VHF RF element and said VHF RF feed;

a UHF antenna, comprising:

a first front UHF RF element attached to said anterior region of said garment;

a second front UHF RF element attached to said anterior region of said garment so that first and second front UHF RF elements are separated by a gap;

a front UHF RF feed electrically connected to said first front UHF RF element for providing RF energy to said first front UHF RF element;

a front UHF ground feed electrically connected to said second front UHF RF element;

a first back UHF RF element attached to said dorsal region of said garment;

a second back UHF RF element attached to said dorsal region of said garment so that first and second back UHF RF elements are separated by a gap;

a back UHF RF feed electrically connected to said first back UHF RF element for providing RF energy to said first back UHF RF element;

a back UHF ground feed electrically connected to said second back UHF RF element;

at least one first connecting wire electrically connected between said first front and said first back UHF RF elements;

at least one second connecting wire electrically connected between said second front and said second back UHF RF elements.

5. The man-portable wearable antenna system of claim 4, wherein said electrically nonconductive garment comprises a flak vest.

6. The man-portable wearable antenna system of claim 4, wherein said first and second VHF RF elements, said first and second front UHF RF elements, and said first and second back UHF RF elements are made of a flexible electrically conductive material.

7. The man-portable wearable antenna system of claim 1, wherein said body antenna comprises:

a first electrically nonconductive garment to be worn about the upper body of said wearer having anterior and dorsal regions, left and right side regions;

first and second conductive elements attached to said first electrically nonconductive garment, wherein said first conductive element extends substantially along said left side region to said dorsal region of said first garment and said second conductive element extends substantially along said right side region to said dorsal region of said first garment;

a HF RF feed attached to said dorsal region of said first electrically nonconductive garment, said HF RF feed electrically connected to said first conductive element for providing RF energy to said first conductive element;

a HF ground feed electrically attached to said second conductive element;

a second electrically nonconductive garment to be worn about the lower body of said wearer having left and right side regions;

first and second longitudinal conductive strips having top and bottom ends attached along said left and right side regions of said second electrically nonconductive garment, wherein said first and second longitudinal conductive strips extend substantially along the length of said second garment and vertically when said wearer is in a standing position and said top ends are attached to said first and second conductive elements; and first and second conductive inserts for lining the inners sole of footwear to be worn by said wearer attached to said bottom ends of said first and second longitudinal conductive strips.

8. The man-portable wearable antenna system of claim 7, wherein said first electrically nonconductive garment comprises a flak vest.

9. The man-portable wearable antenna system of claim 7, wherein said conductive elements, longitudinal conductive strips, and conductive inserts are made of a flexible electrically conductive material.

10. The man-portable wearable antenna system of claim 1 wherein said means for routing signals between one of said antennas and a communication device comprises a switch.

11. The man-portable wearable antenna system of claim 1 wherein said means for routing signals between one of said antennas and a communication device comprises a quadraplexer.

12. A method for forming a man-portable wearable antenna system to be worn by a wearer, comprising the steps of:

forming a helmet antenna to be worn on the head of said wearer, wherein said helmet antenna transmits and receives signals over a frequency range of 500 MHz through 2500 MHz;

forming a vest antenna to be worn around the torso of said wearer, wherein said vest antenna transmits and receives signals over a frequency range of 30 through 500 MHz;

forming a body antenna to be worn along the entire body of said wearer, wherein said body antenna transmits and receives signals over a frequency range of 2 MHz through 30 MHz; and providing a means for routing signals between one of said antennas and a communication device.

13. The method of claim 12, wherein said step of forming a helmet antenna comprises the steps of:

attaching a first helmet RF element to a liner shaped to fit over a helmet;

attaching a second helmet RF element to said liner so that said first and second helmet RF elements are separated by a gap;

connecting a helmet RF feed to said first helmet RF element for providing energy to said first helmet RF element;

connecting a helmet ground feed to said second helmet RF element;

attaching a first helmet shorting strap to said first and second helmet RF elements opposite from said helmet RF feed, for providing an electrical connection between said first and second helmet RF elements; and attaching a second helmet shorting strap to said first and second helmet RF elements between said first helmet shorting strap and said helmet RF feed.

14. The method of claim 12, wherein said step of forming a vest antenna comprises the steps of:

forming a VHF antenna on an electrically nonconductive garment having anterior and dorsal regions, left and right shoulder regions, left and right side regions, wherein said step of forming a VHF antenna comprises the steps of;

attaching a first VHF RF element to said garment;

attaching a second VHF RF element to said garment so that first and second VHF RF elements are separated by a gap;

connecting a VHF RF feed to said first VHF RF element on said dorsal region of said garment for providing energy to said first VHF RF element;

connecting a VHF ground feed to said second VHF RF element;

attaching a VHF shorting strap to said first and second VHF RF elements on said anterior region of said garment;

connecting first and second shoulder straps between said anterior and said dorsal regions of said first VHF RF element and extending over said left and right shoulder regions of said garment; and connecting a matching circuit between said first VHF RF element and said VHF RF feed;

forming a UHF antenna on said electrically nonconductive garment, wherein said step of forming a UHF antenna comprises the steps of:

attaching a first front UHF RF element to said anterior region of said garment;

attaching a second front UHF RF element to said anterior region of said garment so that first and second front UHF RF elements are separated by a gap;

connecting a front UHF RF feed to said first front UHF RF element for providing RF energy to said first front UHF RF element;

connecting a front UHF ground feed to said second front UHF RF element;

attaching a first back UHF RF element to said dorsal region of said garment;

attaching a second back UHF RF element to said dorsal region of said garment so that first and second back UHF RF elements are separated by a gap;

connecting a back UHF RF feed to said first back UHF RF element for providing RF energy to said first back UHF RF element;

connecting a back UHF ground feed to said second back UHF RF element;

attaching at least one first connecting wire between said first front and said first back UHF RF elements; and attaching at least one second connecting wire between said first front and said first back UHF RF elements.

15. The method of claim 12, wherein said step of forming a body antenna comprises the steps of:

attaching first and second conductive elements to a first electrically nonconductive garment to be worn about the upper body of said wearer having anterior and dorsal regions, left and right side regions, wherein said first conductive element extends substantially along said left side region to said dorsal region of said first garment and said second conductive element extends substantially along said right side region to said dorsal region of said first garment;

attaching a HF RF feed to said dorsal region of said first electrically nonconductive garment;

connecting said HF RF feed to said first conductive element for providing RF energy to said first conductive element;

connecting a HF ground feed to said second conductive element;

attaching first and second longitudinal conductive strips having top and bottom ends to a second electrically nonconductive garment to be worn about the lower body of said wearer having left and right side regions, wherein said first and second longitudinal conductive strips are attached along said left and right side regions of said second garment and extend substantially along the length of said second garment and vertically when said wearer is in a standing position and said top ends are attached to said first and second conductive elements; and attaching first and second conductive inserts for lining the inners sole of footwear to be worn by said wearer to said bottom ends of said first and second longitudinal conductive strips.

* * * * *